United States Patent [19]

Nagano et al.

[11] 4,128,756

[45] Dec. 5, 1978

[54] COUNT CONTROL APPARATUS

[75] Inventors: Akira Nagano, Nagaokakyo; Kazuaki Urasaki, Muko; Akira Osato, Mishima; Isao Sakurai, Tokyo, all of Japan

[73] Assignees: Omron Tateisi Electronics Co., Kyoto; Konishiroku Photo Industry Co., Ltd., Tokyo, both of Japan

[21] Appl. No.: 800,714

[22] Filed: May 26, 1977

[30] Foreign Application Priority Data

May 31, 1976 [JP] Japan ..... 51-63814

[51] Int. Cl.[2] ..... G06M 3/02; G06B 27/06

[52] U.S. Cl. ..... 235/92 SB; 235/92 PE; 235/92 R; 355/14

[58] Field of Search ..... 235/92 SB, 92 PE, 92 CA, 235/92 CT; 355/14

[56] References Cited

U.S. PATENT DOCUMENTS

| | | | |
|---|---|---|---|
| 3,800,253 | 3/1974 | Bryant | 235/92 SB |
| 3,886,329 | 5/1975 | Kamiyama | 235/92 SB |
| 3,900,740 | 8/1975 | Akimoto et al. | 355/14 |
| 4,044,232 | 8/1977 | Hubbard | 235/92 SB |

*Primary Examiner*—Joseph M. Thesz

*Attorney, Agent, or Firm*—W. G. Fasse; W. W. Roberts

[57] ABSTRACT

A count control apparatus for controlling a photocopying machine is constructed to be enabled by a copy command signal to effect repetitive photocopying operations and to generate a sheet number pulse for each photocopying operation wherein a desired number of sheets being photocopied by said photocopying machine is preset by a keyboard or the like. The sheet number pulses are counted, the preset number is compared with the count number, and the copy command signal is generated in response to a comparison of the count value with the preset value. Normally the copy command signal is conditioned by a comparison of the count number with the preset number. However the copy command signal is prevented from being conditioned by the comparison in response to a manual changing of the presetting whereby the copy command signal is conditioned in a different manner during the changing of the presetting, whereby a differently conditioned copy command signal is provided. After the preset number is changed manually to a new desired preset number, the copy command signal is again conditioned by said comparison but responsive to the manual completion of the presetting change mode.

29 Claims, 6 Drawing Figures

COUNT CONTROL APPARATUS

BACKGROUND OF THE INVENTION

1. Field of the Invention

The present invention relates to a count control apparatus. More specifically, the present invention relates to a count control apparatus that counts the number of processing operations of a processing unit such as an electronic photocopying machine or the like and which controls the processing unit responsive to the count output.

2. Description of the Prior Art

It has been a common practice in an electronic photocopying machine, for example, that a desired number of sheets being photocopied consecutively is preset and a repetitive photocopying operation is consecutively effected at a predetermined photocopying operation speed responsive to the preset number and the repetitive photocopying operation is controlled by counting the number of sheets actually photocopied and comparing the count number with the preset number. A recent model of an electronic photocopying machine is structured such that a desired number of sheets being photocopied consecutively may be preset by inputting the numerical value by the use of a keyboard of a ten key type. Such a type of numerical value entry device as allows presetting of the number of sheets in an electronic manner is more advantageous as compared with one which is of a mechanical structure such as a rotary switch or the like, particularly in case where a large number of sheets should be preset because a rotary switch must be adjustable for each of several digit positions of the numerical value.

However, it could happen that the preset number of sheets being photocopied must be changed to a new larger or smaller number, while the photocopying operation is progressing consecutively at the photocopying speed of the photocopying machine in accordance with the originally preset number of sheets. In order that a new larger or smaller number of sheets to be photocopied may be preset by the use of an electronic numerical value entry device, it was necessary in the prior art to stop the photocopying operation of the photocopying machine and then to clear the formerly preset numerical value and to reset a new numerical value for a larger or smaller number of sheets to be photocopied. In such a situation, if a new numerical value is inputted without clearing the formerly preset numerical value, a confusion is caused between the formerly preset numerical value and a newly preset numerical value. For example, assuming that the numerical value "50" has been preset and a change of the numerical value is desired from the formerly preset numerical value "50" to a new preset numerical value "35" when ten sheets have already been photocopied, entry of only the numeral "3" for the first digit causes a display of the value "03" or "3"; however, it cannot be determined whether the new preset numerical value is the numeral "3", or whether the preset numeral "3" is followed by a further entry of the numeral "5" to establish the numerical value "35", and therefore the photocopying machine must be stopped until the new numerical value "35" is fully entered, inasmuch as entry of only the numeral "3" is smaller than the number of sheets actually photocopied so far by that time. In other words, with a typical conventional electronic photocopying machine, it always happens that if a new number of sheets being photocopied is preset in the course of the consecutive photocopying operation in accordance with the previously preset number of sheets being photocopied, the photocopying machine is brought to a stop for the time period necessary for entering a new numerical value for the new number of sheets to be photocopied. The manual entry of such a new numerical value requires some time and hence decreases the efficiency of the photocopying operation, in spite of the fact that the recent electronic photocopying machines have been much improved in their photocopying speed. Thus, it is desirable that after a number of sheets being photocopied is once preset, the preset number of sheets to be photocopied may be changed as desired even in the course of the consecutive photocopying operation without interrupting the consecutive photocopying operation.

SUMMARY OF THE INVENTION

Briefly described, the present invention comprises a count control apparatus wherein the number of times of a repetitive processing operation by a processing unit, is preset by a numerical value entry device, such as a keyboard of a ten key type or the like, the number of processing operations actually effected by said processing unit is counted, and said processing unit is controlled in response to or in association with a comparison of the counted value with the preset value. The manually operable means, such as a clear key, a ten key set or the like, is constructed so that the operation of said manually operable means during the processing makes the control of the processing unit non-responsive to said comparison of the counted value with the preset value while the preset number is changed, whereby said processing unit may be controlled in response to a different condition, such as a new number of processing operations.

Preferably, such a different condition is generated as a signal for commanding said processing unit to continue the processing operation during the time period when the preset number is changed. Preferably, the preset number of processing operations is changed to a new number of processing operations, so that when a presetting change is completed the control of the processing unit is again responsive to a comparison of the counted value with the new preset value and the machine returns to a normal processing operation is regained based on the new preset number of times of processing operations. The said time period for presetting change may be determined by operation of a specified key, counting of the number of processing operations, lapse of a given time period or the like.

Therefore, a principal object of the present invention is to provide an improved count control apparatus for controlling a processing unit which counts the number of processing operations of the processing unit and controls the processing unit in association with a comparison of the count value with a preset value.

Another object of the present invention is to provide an improved count control apparatus for controlling a processing unit in association with a comparison of a count number of processing operations of said processing unit with a preset number of processing operations, wherein the preset number can be changed without interrupting the processing operations of the processing unit.

A further object of the present invention is to provide an improved count control apparatus for controlling a processing unit in association with a comparison of the count number of the processing operations of the processing unit with a preset number of the processing operations, wherein the preset number can be manually changed as desired within a given restricted time period while the processing unit is performing the consecutive processing operations.

Still a further object of the present invention is to provide an improved count control apparatus for controlling a processing unit in association with a comparison of the count number of the processing operations with a preset number of the processing operations, wherein the preset number can be changed as desired during the consecutive processing operations of the processing unit, without causing undesired processing operations when a longer time period is required for presetting change.

These objects and other objects, features, aspects and advantages of the present invention will become more apparent from the following detailed description when taken in conjunction with the accompanying drawings.

DESCRIPTION OF THE PREFERRED EMBODIMENTS

Figure 1:
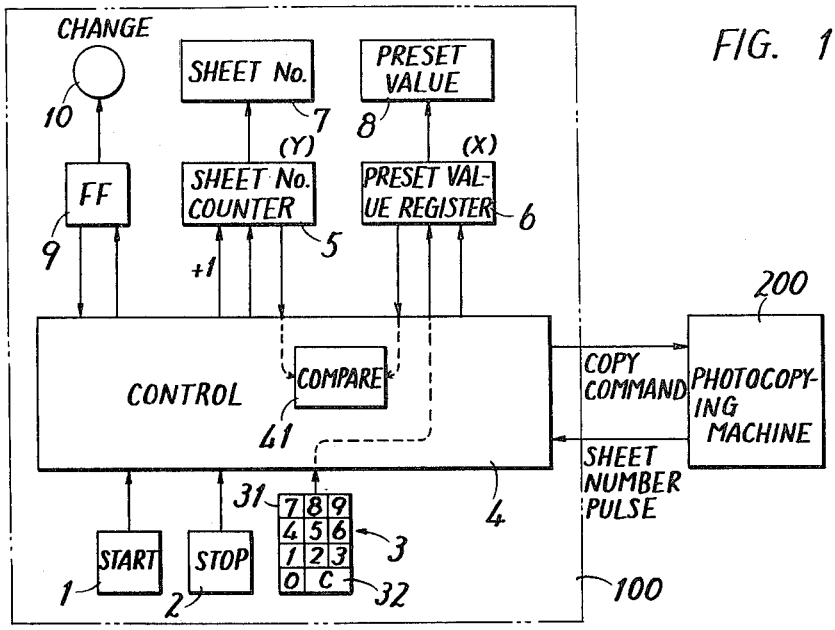
FIG. 1 is a block diagram showing one embodiment of the present invention.

FIG. 1 shows a block diagram of one embodiment of the present invention. The embodiment shown comprises a count control apparatus 100 adapted for controlling the number of consecutive processing operations of an external processing unit 200. Typically the processing unit 200 comprise an electronic photocopying machine making a repetitive photocopying operation at a predetermined photocopying operation speed of 20 sheets per minutes, for example. Thus, in the embodiment shown, the count control apparatus 100 is used as a photocopying machine control apparatus for the photocopying machine 200.

The photocopying machine control apparatus 100 comprises a control 4 which is connected to a start key 1 for instructing initiation of the photocopying machine 200, a stop key 2 for instructing stoppage of the photocopying machine 200, a keyboard 3 for entering a numerical value such as a desired number of sheets being photocopied, which includes a ten key set 31 and a clear key 32, a sheet number counter 5, a preset value register 6, and a flip-flop 9. The photocopying machine 200 is structured such that the machine is responsive to a copy command signal to be enabled to make consecutive photocopying operations and provides a sheet number pulse for each photocopying operation. Thus, the control 4 is also connected to the photocopying machine 200 to send a copy command signal to the photocopying machine 200 and to receive a sheet number pulse from the photocopying machine 200.

Typically the control 4 may comprise a microprocessor designed to perform various steps to be described subsequently. Alternatively, the control 4 may be implemented by a combination of various blocks to perform substantially the same operation. An example of such a hardware implementation of the control 4 is described in detail subsequently with reference to FIG. 1A. However the control 4 is implemented, a major function of the control 4 comprises a comparing operation of the data in the sheet number counter 5 and the data in the preset value register 6. To that end, the control 4 is shown comprising a comparator 41 for simplicity of explanation.

The sheet number counter 5 is structured such that the counter 5 is responsive to a sheet number pulse to be received from the photocopying machine 200 through the control 4 as an add one (+1) signal to make a count up operation one by one and is responsive to a clear signal from the control 4 to be cleared, while the counter 5 transmitts the count number data to the comparator 41 of the control 4. The preset value register 6 is structured such that the register is responsive to a data signal to be entered from the keyboard 3 through the control 4 to store the received data and is also responsive to a clear signal from the control 4 to be cleared, while the register 6 transmits the stored data to the comparator 41 of the control 4. Thus, the contents in the counter 5 and the register 6 are compared from time to time by the comparator 41. The flip-flop 9 is structured to receive the set and reset signals from the control 4 and to provide the corresponding outputs to the control 4. As becomes apparent from the subsequent description, the flip-flop 9 is set only when the preset value in the preset value register 6 is changed and is reset when the presetting change operation is completed. Thus, the set output of the flip-flop 9 indicates that the control apparatus 100 is being changed of the preset value stored in the preset value register 6. Therefore, a presetting change display lamp 10 is connected to the flip-flop 9 for the purpose of indicating that the apparatus 100 is being changed of the preset value stored in the preset value register 6 or the apparatus 100 is in the presetting change mode. The sheet number counter 5 is also connected to the sheet number display 7 for the purpose of indicating the sheet number data stored in the sheet number counter 5, while the preset value register 6 is also connected to the preset value display 8 for the purpose of indicating the preset value stored in the preset value register 6.

As described previously, typically the control 4 is implemented by a microprocessor. In such an instance, the micro processor is designed to process various signals and data to communicate with the above described various blocks 1, 2, 3, 9, 5, 6 and 200 to achieve a desired sequence of operation steps. In the following, therefore, the operation of the photocopying machine control apparatus 100 will be described, centering on the operation of the control 4.

In operation, first consider a photocopying operation by a normal sheet number presetting. To that end an operator enters a desired number of sheets being photocopied (X) by means of the ten key set 31 included in the keyboard 3. The preset value X is transferred as a data signal through the control 4 to the preset value register 6 and accordingly the preset value X is stored in the register 6.

Then, the operator depresses the start key 1. A clear signal is generated by the control 4 responsive to the depression of the start key 1 and is applied to the sheet number counter 5, thereby to reset the counter 5. In such a situation, a copy command signal is generated by the control 4 in association with a comparison of the contents in the sheet number counter 5 and the preset value register 6, as to be more fully described subsequently, and is applied to the photocopying machine 200. As a result, the photocopying machine 200 is enabled to initiate the consective photocopying operations and a sheet number pulse is generated for each photocopying operation and is sent back to the control 4. The sheet number pulse is applied as an add one signal through the control 4 to the sheet number counter 5 which has been reset as described above, whereby the sheet number counter 5 makes a count up operation one by one each time the photocopying operation is carried out by the photocopying machine 200.

Now description will be made of how the photocopying machine 200 is controlled responsive to or in association with a comparison of the contents in the sheet number counter 5 and the preset value register 6. As described previously, the comparator 41 serves to compare the number of photocopied sheets Y stored in the sheet number counter 5 and the preset number X stored in the preset value register 6. If the above described preset value X is larger than the photocopied sheet number Y, the comparator 41 continues to generate a photocopy uncompleted signal, whereas if the above described preset value X is smaller than or is equal to the photocopied sheet number Y, the comparator 41 generates a photocopy completed signal. The control 4 serves to send this photocopy uncompleted signal as a copy command signal to the photocopying machine 200, while the control 4 ceases to send a copy command signal when the photocopy completed signal is obtained. Therefore, whenever the above described photocopy completed signal is obtained, i.e. the preset value X is smaller than or is equal to the photocopied sheet number Y, the photocopying machine 200 is caused to stop a photocopying operation. During the successive photocopying operations by the photocopying machine 200, the sheet number pulse is generated for each photocopying operation and is counted by the sheet number counter 5. As a result, the sheet number display 7 displays from time to time the photocopied sheet number Y, while the preset value display 8 displays the initial preset value X stored in the preset value register 6.

Now that a photocopying operation by a normal sheet number presetting was considered in the foregoing, next consider a case where the preset value is to be changed to a new one during the successive photocopying operations or while the photocopying operation is being successively effected by the photocopying machine 200 responsive to the copy command signal. Now assume that the sheet number counter 5 has already counted the number of sheets Y1 as already photocopied by that time.

For the purpose of changing the first preset value stored in the preset value register 6 to a new preset value, first of all the operator depresses a clear key 32. The control 4 generates a set signal responsive to the depression of the clear key 32, on condition that the photocopying operation is being effected by the photocopying machine 200. The set signal is applied to the flip-flop 9. Therefore, the flip-flop 9 is set and the set output therefrom causes the presetting change display lamp 10 to be lighted accordingly and is also returned to the control 4. The control 4 also generates a clear signal responsive to the depression of the clear key 32, on condition that the photocopying operation is being effected by the photocopying machine 200. The clear signal is applied from the control 4 to the preset value register 6, whereby the preset value register 6 is cleared. The control 4 is also responsive to the set output from the flip-flop 9 to prevent or release a responsive relation or an associated relation of the copy command signal applied to the photocopying machine 200 with a comparison output of the comparator 41 for providing a copy command signal. In other words, the control 4 is responsive to the set output from the flip-flop 9 to make the copy command signal irresponsive to a comparison output of the comparator 41 and to generate an alternative copy command signal to the copy command signal line of the photocopying machine 200. Thus, it would be appreciated that the copy command signal is normally conditioned by the comparison output of the comparator 41 but the normal conditioning of the copy command signal based on the comparison output from the comparator 41 is released by depression of the stop key 2, whereupon the copy command signal is differently conditioned by the set ouptut of the flip-flop 9. It would be further appreciated that in such a sitatuion the photocopying machine 200 is kept supplied with the copy command signal, although the preset value register 6 is cleared, with the result that the photocopying machine 200 continues the successive photocopying operations so long as the flip-flop 9 is set and the copy command signal is differently conditioned thereby.

As a further step for changing the preset value stored in the preset register 6, the operator enters a new numerical value X1 to which a change of the former preset value is desired by means of the ten key set 31. Accordingly, the preset value register 6 is loaded with a new preset value X1. Then, the operator again depresses the clear key 32 at the completion of this presetting change mode. On condition that the flip-flop 9 has been set, i.e. on condition that the presetting change mode is progressing, the control 4 is responsive to redepression of the clear key 32 to provide a reset signal to the flip-flop 9. Accordingly, the flip-flop 9 is reset and the presetting change display lamp 10 is turned off, while the reset signal is applied from the flip-flop 9 to the control 4. Therefore, the copy command signal line is released of the above described prevention from the responsive or associated relation with the comparison output of the comparator 41 and is returned to the normal sheet number presetting operation; however, the preset value register 6 has already been loaded with a new preset value and hence the copy command signal is conditioned by a comparison of a further count value with the said new preset value.

If it is desired to stop the photocopying machine at any time, the stop key 2 is depressed. Then the control 4 is responsive to the depression of the stop key 2 to cause the copy command signal to be discontinued and to provide a reset signal to the flip-flop 9. Accordingly, the photocopying machine 200 is brought to a stop and the flip-flop 9 is reset.

As discussed previously, in the course of the above described presetting change operation mode, the photocopying machine 200 is adapted to be prevented from being controlled by the comparison output of the comparator 41 between the contents in the sheet number counter 5 and the preset value register 6, but instead an alternative command signal is obtained from the control 4 responsive to the output of the flip-flop 9, whereby the photocopying machine 200 is kept effecting the consecutive photocopying operations. Therefore, the sheet number counter 5 continues to make a count up operation, while the count value of the counter 5 changes by successive addition of an add one signal to the count value Y1 immediately before the presetting change mode was initiated. During the above described presetting change mode, in other words, so long as the flip-flop 9 is set, even if the photocopied sheet number Y becomes larger than or becomes equal to the preset number X, the photocopying machine 200 still continues the consecutive photocopying operation, until the clear key 32 is depressed for the purpose of the presetting change mode completion, inasmuch as the photocopying machine 200 has been prevented from being controlled or conditioned by the comparison of the contents in the sheet number counter 5 and the preset value register 6 and instead has been controlled or conditioned by the set output of the flip-flop 9. If and when the photocopied sheet number Y becomes larger than or becomes equal to the preset value X1 after the presetting change mode is completed by redepression of the clear key 32, the copy command signal which has now been made to be controlled or conditioned by the comparison output of the comparator 41 is interrupted and thereafter the photocopying machine 200 is brought to a stop.

Although in the foregoing description the control 4 was described as implemented such that the presetting change mode was instructed by the use of the clear key 32. Alternatively, the control 4 may be implemented such that the presetting change mode may be instructed as described in the following. More specifically, the presetting change mode may be initiated by depression of any one key of the ten key set 31 during the normal successive photocopying operations by the photocopying machine 200. Also, in the foregoing description, the control 4 was described as implemented such that the presetting change mode is completed by depression of the clear key 32. Instead, however, the control 4 may be implemented such that the presetting chagne mode is completed by detection of entry of a predetermined number of digits for the purpose of reentering a new preset value, provided that the operator is instructed to enter the said predetermined number of digits for the purpose of reentry of a new desired preset value, such as "009", "035", "125", and so on rather than "9", "35", "125", and so on in case where the said predetermined number of digits is three. In other words, the control 4 may be implemented such that the flip-flop 9 is set responsive to depression of the ten key set 31 during the successive photocopying operations of the photocopying machine 200 and is reset responsive to a predetermined number of digits, for example, three digits of "009", "035", "125" and so on, having been key inputted. Instead, the control 4 may be implemented such that the flip-flop 9 is reset by operation of another specified key, such as the clear key 31 or the start key 1, for the purpose of the presetting change completion.

Figure 1A:
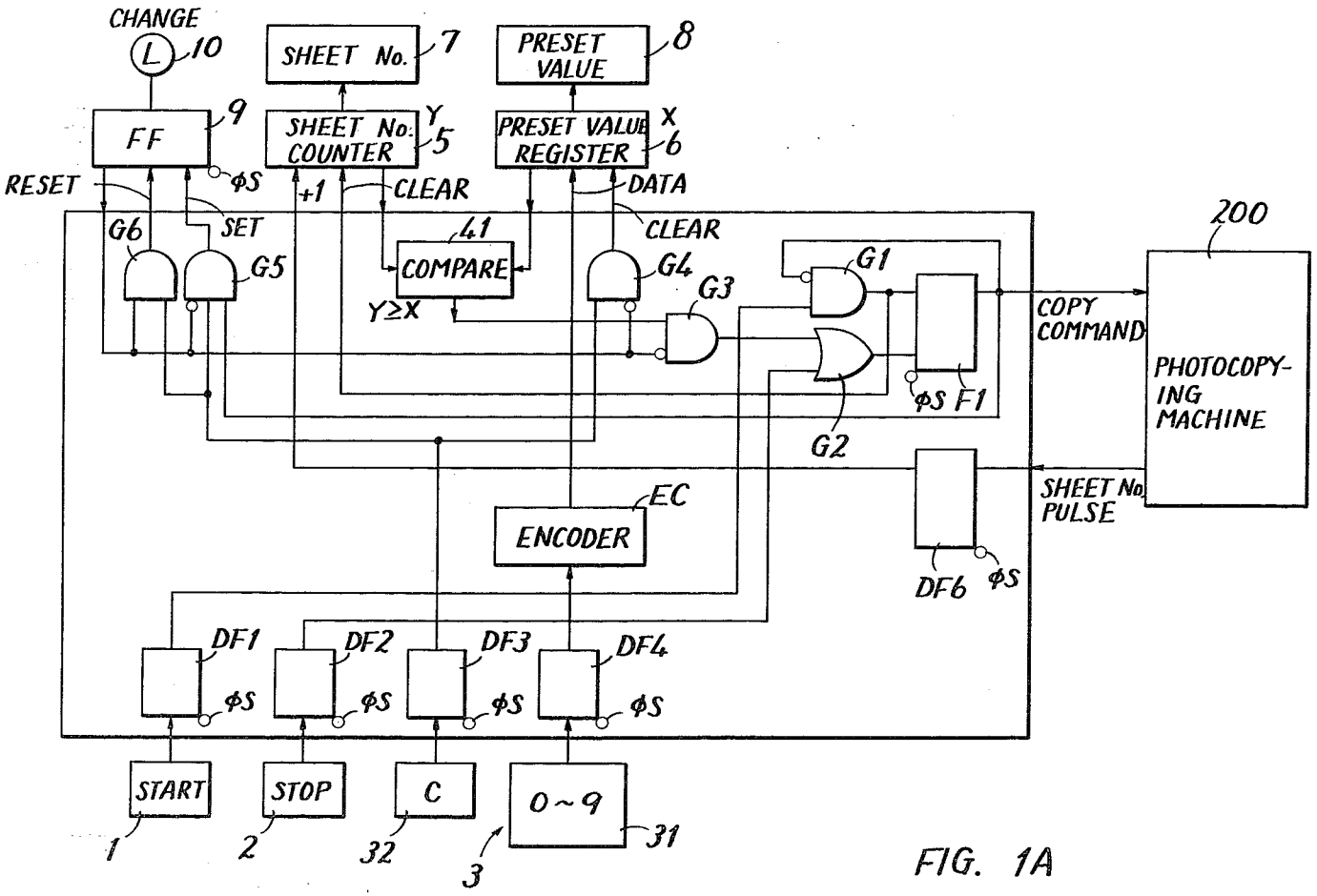
FIG. 1A is a block diagram of a control in the FIG. 1 embodiment.

As described previously, typically the control 4 may be implemented by a microprocessor. Alternatively, however, the control 4 may be implemented by a hardware configuration specially designed to achieve the above discussed sequence of operation steps. FIG. 1A shows a block diagram of one embodiment of the control 4 implemented by such a specially designed hardware configuration. In the following, therefore, the operation of the FIG. 1A embodiment will be described, centering on the operation of the control 4.

In operation, first let it be assumed that a flip-flop F1 has been reset and therefore a copy command signal is not obtained and hence the photocopying machine 200 has been brought to a stop. Now consider a photocopying operation by normal sheet number presetting. To that end an operator enters a desired number of sheets being photocopied X by using the ten key set 31 included in the keyboard 3. The numerical value as entered by the keyboard 3 is coded by an encoder EC and is transferred as a data signal to the preset value register 6 and accordingly the preset value X is stored in the register 6.

Then, the operator depresses the start key 1. The signal of depression of the start key 1 is differentiated by a differentiator DF1 and the output of the differentiator DF1 is applied to a gate G1. Since the flip-flop F1 has been reset, as described previously, and the input condition of the gate G1 is met, an output is obtained from the gate G1 and the flip-flop F1 is set. Since the flip-flop F1 is set, the gate G1 comes to be inhibited by the set output of the flip-flop F1. The above described output of G1 is also applied to the sheet number counter 5 as a clear signal, whereby the counter 5 is reset or cleared. The set output of the flip-flop F1 is applied to the photocopying machine 200 as a copy command signal. As a result, the photocopying machine 200 is enabled to initiate the consecutive photocopying operations and a sheet number pulse is generated for each photocopying operation and is sent back to the control 4. The sheet number pulse as sent back is differentiated by a differentiator DF6 and is applied as an add one signal to the sheet number counter 5. Therefore, the sheet number counter 5 makes a count up operation one by one each time the photocopying operation is carried out by the photocopying machine 200.

The comparator 41 compares the number of photocopied sheets Y stored in the sheet number counter 5 with the preset number X stored in the preset value register 6. If and when the above described preset value X is larger than the photocopied sheet number Y, the output of the comparator 41 remains the low level, whereas if and when the photocopied sheet number Y becomes equal to or larger than the above described preset value X the output of the comparator 41 becomes the high level. Since the flip-flop 9 has been reset at that time, a gate G3 has not been inhibited. Therefore, the input condition of the gate G3 is met and the output of the high level is obtained from the gate G3. The output of the gate G3 is applied through an OR gate G2 to the reset input of the flip-flop F1, whereby the flip-flop F1 is reset. As a result, the copy command signal is discontinued thereafter and accordingly the photocopying machine 200 is brought to a stop.

Now consider a presetting change operation mode wherein the preset value is changed to a new one during the successive photocopying operations. Let it be assumed that the sheet number counter 5 has already counted the number of sheets Y1 as already photocopied by that time. In order to initiate the presetting change mode, the operator depresses the clear key 32. The output of depression of the clear key 32 is differentiated by a differentiator DF3 and the differentiated output is applied to the gates G4, G5 and G6. Since the flip-flop 9 has been reset and the flip-flop F1 has been set in such a situation, the input condition of the gate G5 is met and the output of the high level is obtained from the gate G5 and is applied as a set signal to the flip-flop 9. Accordingly, the flipflop 9 is set. Similarly the input condition of the gate G4 is met and the output of the high level is obtained from the gate G4. The output of the gate G4 is applied as a clear signal to the preset value register 6, whereby the register 6 is cleared. Since the flip-flop 9 is set, the set output of the high level is obtained from the flip-flop 9 and is applied to the gates G3 and G4, whereby these gates G3 and G4 are inhibited. Since the gate G3 is inhibited, the output of the comparator 41 is not allowed to be fed to the reset input of the flip-flop F1. In other words, the reset input of the flip-flop F1 is made irresponsive to the output of the comparator 41 and hence the flip-flop F1 remains set. Thus, it would be appreciated that the copy command signal is provided as a set output of the flip-flop F1 the reset input of which is normally conditioned by the comparison output of the comparator 41 but the normal conditioning of the reset input of the flip-flop F1 based on the comparison output of the comparator 41 is released by depression of the stop key 2, whereupon the reset input of the flip-flop F1 is differently conditioned by the set output of the flip-flop 9. It would be further appreciated that in such a situation the photocopying machine 200 is kept supplied with the copy command signal, although the preset value register 6 has been cleared, with the result that the photocopying machine 200 continues the successive photocopying operations so long as the flip-flop 9 is set, irrespective of the output of the comparator 41.

For the purpose of presetting a new desired preset value in the preset register 6, the operator enters a new numerical value X1 using the ten key set 31. Accordingly, the new preset value X1 is loaded in the preset value register 6 in the same manner as discussed in conjunction with entry of the initial preset value. Then, the operator again depresses the clear key 32 for the purpose of terminating the presetting change mode. The output of the clear key 32 is again differentiated by the differentiator DF3 and is applied to the gates G4, G5 and G6. Since the flip-flop 9 has been set at that time, the input condition of the gate G6 is met and the output of the high level is obtained from the gate G6. The output of the high level from the gate G6 is applied as a reset signal to the flipflop 9. Accordingly, the flip-flop 9 is reset. Since the flip-flop 9 has been set at that time, as described above, the gate G4 has been inhibited and the preset value register 6 is prevented from being cleared by the differentiated output from the differentiator DF3. Since the flip-flop 9 is thus reset, the inhibitiion of the gates G3 and G4 is released. As a result, the output of the gate G3 becomes to be soly dependent on the output of the comparator 41. The reset input of the flip-flop F is thus made again responsive to the output of the comparator 41. Therefore, the flip-flop F1 is reset only if and when the count number in the counter 5 becomes equal to or larger than the new preset value in the preset value register 6. In other words, the copy command signal is again conditioned by a comparison of a further count value with the new preset value.

If it is desired to stop the photocopying machine 200 at any time, the stop key 2 may be depressed. Then the output of the stop key 2 is differentiated by a differentiator DF2 and is applied through the gate G2 to the reset input of the flip-flop F1, whereby the flip-flop F1 is reset and the copy command signal is discontinued. As a result the photocopying machine 200 is brought to a stop.

From the foregoing description it would be appreciated that the FIG. 1 embodiment is adapted such that normally the successive photocopying operations are conditioned by or controlled by a comparison of the photocopied number and the preset number but the successive photocopying operations are prevented from being conditioned by the said comparison responsive to initiation of the presetting change mode but instead are made to be conditioned in a different manner during the presetting change mode, and returned to be conditioned again by the said comparison responsive to completion of the presetting change mode. Therefore, if a longer time period is consumed for entry of a new desired preset value, it could happen that the consecutive photocopying operations are effected more than the new preset value before the presetting change mode is completed. It could also happen that the operator initiates the presetting change mode by depressing the clear key 32 and reenters a new desired preset value but forgets to end the presetting change mode by again depressing the clear key 32, with the result that the presetting change mode is not ended or completed. In such a situation the successive photocopying operations are carried out undesirably and excessively. Thus, it is desired that some scheme for eliminating excessive photocopying operations through inadvertence of an operator of failure to terminate the presetting change mode. A few modifications for that purpose will be described in the following.

Figure 2:
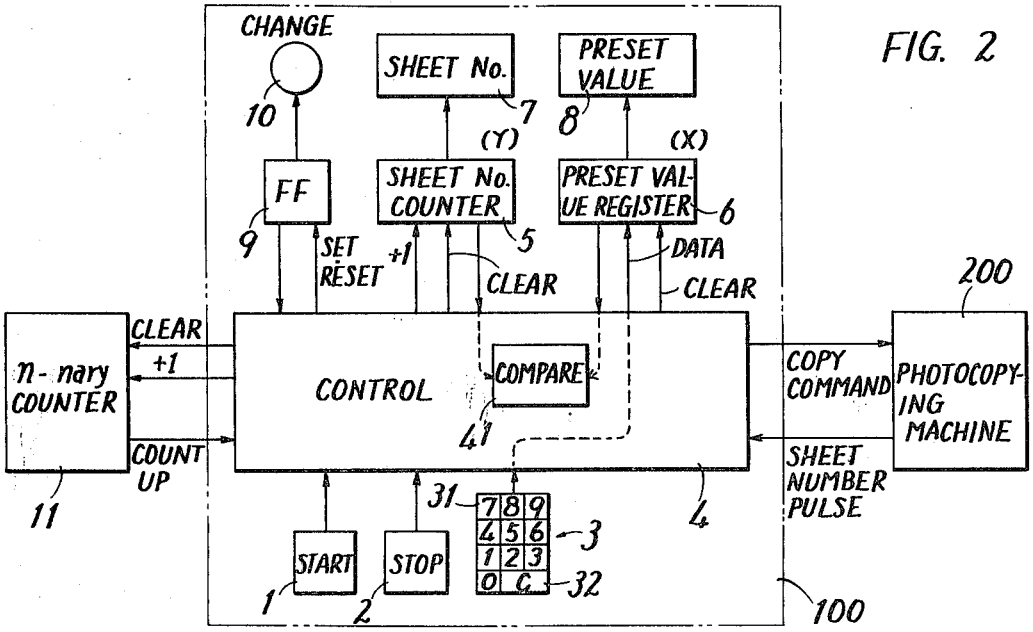
FIG. 2 is a block diagram showing another embodiment of the present invention.

FIG. 2 shows a block diagrm of another embodiment of the present invention. The structure of the FIG. 2 embodiment is substantially the same as that of the FIG. 1 embodiment, except for the following respects. More specifically, an *n*-nary counter 11 is additionally or internally connected to the control 4. The counter 11 is structured such that the counter 11 is responsive to a clear signal to be cleared and responsive to an add one signal to make a count up operation one by one and provides a count up output if and when the counter 11 counts a predetermined number *n*. The counter 11 is utilized to count the number of sheets photocopied after the presetting change mode is initiated, thereby to disable forcibly the photocopying machine 200 if and when a predetermined number of sheets are photocopied after the presetting change mode is initiated. To that end, typically the said predetermined number is selected to be "three". The photocopying operation speed of a typical photocopying machine now commercially available is twenty sheets per minute. Hence, the sheet number of three is commensurate with the time period of about 10 seconds. Thus, it would be appreciated that the FIG. 2 embodiment contemplates automatic stoppage of the photocopying machine 200 after three sheets are photocopied since the presetting change mode is initiated.

In operation, the nomral photocopying operation of the embodiment shown is substantially the same as that of the FIG. 1 embodiment. Now consider a case where the presetting change mode is instructed by depressing the ten key set 31 or the clear key 32, for example. Then the flip-flop 9 is set and the presetting change display lamp 10 is lighted, while the photocopying machine 200 is prevented from being controlled or conditioned by the output of the comparator 41, as described previously. The set output of the flip-flop 9 is applied as a clear signal through the control 4 to the *n*-nary counter 11, whereby the counter 11 is cleared.

After once the presetting change mode is initiated, the control 4 serves to send the sheet number pulse obtainable from the photocopying machine 200 to the $n$-nary counter as an add one signal. Accordingly, the $n$-nary counter 11 makes a count up operation for each photocopying operation of the photocopying machine 200 after once the presetting change mode is initiated. Thus, the $n$-nary counter 11 continues to make a count up operation, and when the value "$n$" is reached, a count up signal is obtained from the $n$-nary counter 11. The count up signal is applied through the control 4 to the flip-flop 9 as a reset signal. Therefore, the flip-flop 9 is reset when the photocopying machine completes the photocopying operations of $n$ sheets after the presetting change mode is once initiated, whereby the control 4 returns to the normal control operation wherein the copy command signal is conditioned by the comparison output of the comparator 41.

In the foregoing description, the flip-flop 9 is adapted to be reset by a count up signal of the $n$-nary counter 11, but alternatively the apparatus 100 may be structured such that the photocopying machine 200 per se may be stopped by the count up signal and the start key 1 may be operated if it is desired to make photocopying operations based upon a new preset value. In such an instance, the normal operation may be regained by depression of the start key 1, whereby the flip-flop 9 is reset.

As seen from the foregoing description, the FIG. 2 embodiment is characterized in that the photocopying machine 200 is prevented from being placed under the control conditioned by the comparison output of the comparator responsive to initiation of the presetting change mode, and instead is placed under the control conditioned by the $n$-nary counter, while the photocopying machine is returned to the control conditioned by the normal comparison output of the comparator automatically or manually based upon the count up signal of the $n$-nary counter. If the presetting change completion is instructed by keying operation before the count up of the $n$-nary counter, of course, the flip-flop 9 is reset by such keying operation. Thus, it would be appreciated that according to the FIG. 2 embodiment undesired and excessive photocopying operations caused by slow entry of a new desired preset value or inadvertent failure to terminate the presetting change mode by the operator can be prevented.

Figure 3:
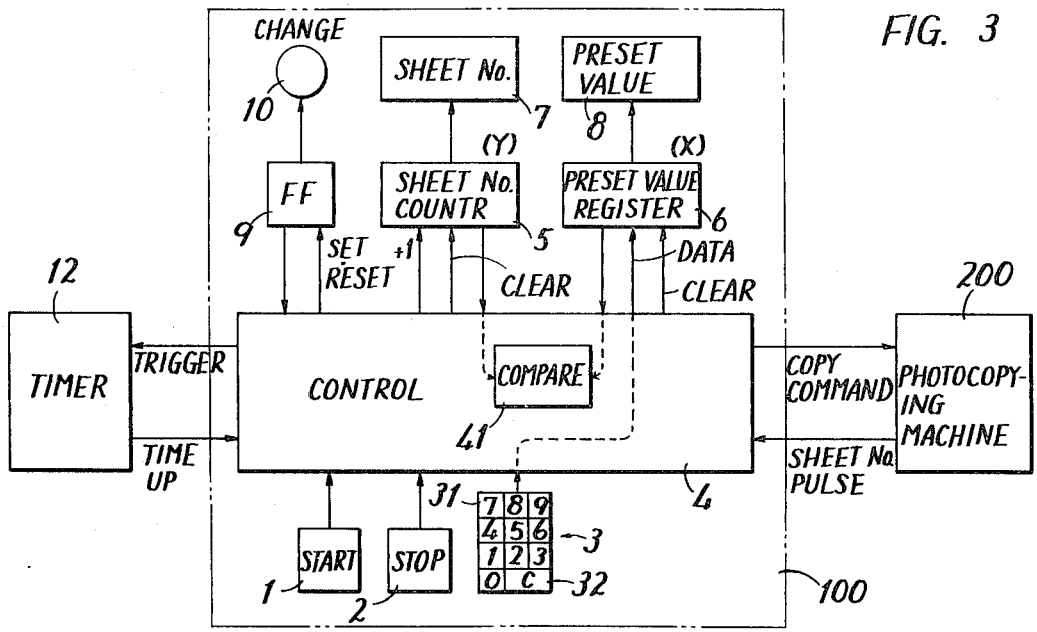
FIG. 3 is a block diagram showing a further embodiment of the present invention.

FIG. 3 is a block diagram of a further embodiment of the present invention. The structure of the embodiment shown is almost the same as that of the FIG. 1 embodiment, except for the following respects. More specifically, a timer 12 is connected additionally or internally to the control 4. The timer 12 is structured such that the timer 12 is triggered by a triggering signal and provides a time up signal after the lapse of a predetermined time period after the same is triggered.

In operation, the normal photocopying operation is substantially the same as that of the FIG. 1 embodiment. Now consider a case where the presetting change mode is instructed by depression of the ten key set 31 or the clear key 32. Then the flip-flop 9 is set and the presetting change display lamp 10 is lighted, and the photocopying machine 200 is prevented from being controlled or conditioned by the comparison output of the comparator 41, as described previously. The set output of the flip-flop 9 is applied through the control 4 to the timer 12 as a triggering signal and accordingly the timer 12 is triggered. The timer 12 may comprise an RC charge/discharge circuit including a logic circuit, or any type of timer circuit which is adapted to be triggered to provide a time up signal after the lapse of a predetermined time period, say 10 seconds.

After the lapse of the predetermined time period since the timer 12 is thus triggered, the timer 12 comes to provide a time up signal. The time up signal is applied through the control 4 to the flip-flop 9 as a reset signal. Accordingly, after the lapse of a predetermined time period since the presetting change mode is initiated, the flip-flop 9 is reset and the control 4 returns to the normal control operation conditioned by the comparison output of the comparator 41.

Although in the foregoing description the flip-flop 9 is adapted to be reset by the time up signal of the timer 12, alternatively the photocopying machine 200 per se may be stopped by the time up signal and the start key 1 may be depressed when it is desired to make the photocopying operation based on a new preset value. In such an instance, the apparatus is adapted such that the normal control operation conditioned by the comparison output of the comparator 41 is regained, i.e. the flip-flop 9 is reset, by depression of the start key 1.

As seen from the foregoing description, according to the FIG. 3 embodiment, the normal control conditioned by the comparison output of the comparator is prevented responsive to initiation of the presetting change mode and instead the control is switched to be conditioned by the output of the timer, while the photocopying machine is adapted to regain the normal control conditioned by the comparison output of the comparator automatically or manually based upon the timer up signal of the timer. Again the FIG. 3 embodiment brings about a less possibility of causing wasteful photocopies through the operator's slow reentry of a desired new preset value or inadvertent failure to terminate the presetting change mode. Of course, the flip-flop 9 may be reset by depression of the key for instructing the presetting change completion before the timer provides a time up signal.

Figure 4:
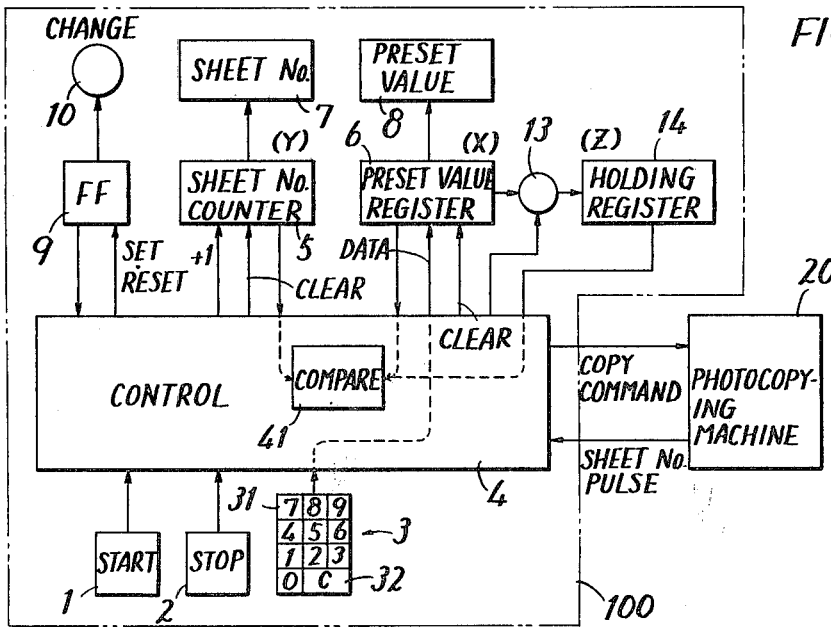
FIG. 4 is a block diagram of still a further embodiment of the present invention.

FIG. 4 is a block diagram showing still a further embodiment of the present invention. Again the structure of the FIG. 4 embodiment is substantially the same as that of the FIG. 1 embodiment, except for the following respects. More specifically, the above described preset value register 6 is connected through a gate 13 to a holding register 14, and the gate 13 is coupled to the control 4 to receive a gate signal therefrom while the holding register 14 is coupled to the control 4 to send the data stored therein to the control 4.

In operation, the successive photocopying operation by the normal presetting is substantially the same as that of the FIG. 1 embodiment. Now descrition will be made of a case where a presetting change mode is effected during the sucessive photocopying operations. In such a situation, if the presetting change mode is instructed by the clear key 32 or the ten key set 31, the flip-flop 9 is set, as described previously. The set output of the flip-flop 9 is applied to the control 4 and accordingly the control 4 provides a gate opening signal to the gate 13. Therefore, the gate 13 is opened for a given short time period and the previously preset value X as stored in the preset value register 6 is transferred to the holding register 14, which transferred value is denoted as a preset value Z. Then, the operator may enter a new preset value X1 by operation of the ten key set 31. The control 4 then makes comparison between the contents in the sheet number counter 5 and the holding register 14, instead of the above described normal comparison between the contents in the counter 5 and the register 6 responsive to the set output of the flip-flop 9. Accordingly, during the presetting change mode, comparison is made between the contents in the holding register 14 (Z: the initially preset value X) and the count value Y in the sheet number counter 5, whereupon a photocopy uncompleted signal is provided when $Z<Y$, and a photocopy completed signal is provided when $Z \leqq Y$. The photocopy uncompleted signal enables a copy command signal to be sent from the control 4 to the photocopying machine 200, whereas the photocopy completed signal makes a copy command signal irresponsive to the comparator 41, as described previously. Therefore, it follows that during the presetting change mode the photocopying machine 200 is placed under the control conditioned by comparison of the count value with the previously preset value.

If the photocopy completed singal is obtained in the comparator 41 through comparison between the contents in the counter 5 and the register 14, the photocopy completed signal is sent as a reset signal from the control 4 to the flip-flop 9. Accordingly, the flip-flop 9 is reset, while the comparator 41 is returned to the normal comparing operation i.e. a comparing operation between the contents in the sheet number counter 5 and the preset value register 6. At that time, the holding register 14 may be cleared. If the initial preset value X (Z) is larger than the new preset value X1, then the photocopying machine 200 is brought to a stop at the timing when the flip-flop 9 is reset.

If and when keying entry of a new preset value X1 is completed after the presetting change mode is instructed before a photocopy completed signal is obtained through comparison by the comparator 41 between the values Z and Y, then the operator may return to the normal operation through depression of the start key 1, for example. Alternatively, the presetting change mode may be completed or terminated through depression of the clear key 32 or responsive to entry of a predetermined number of digits of a new preset value.

Figure 5:
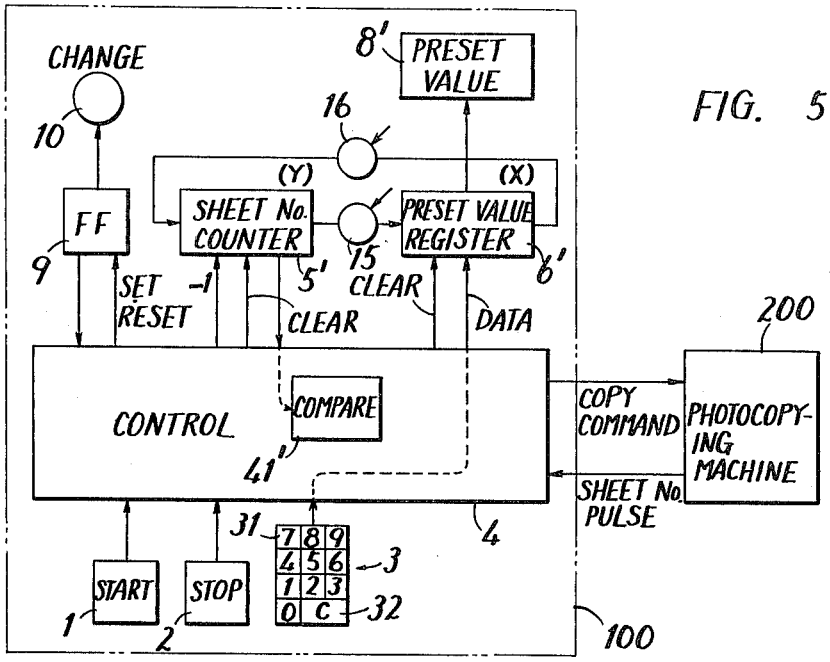
FIG. 5 is a block diagram of still another embodiment of the present invention.

FIG. 5 is a block diagram of still a further embodiment of the present invention. The structure of the embodiment shown is substantially the same as that of the FIG. 1 embodiment, except for the following respects. More specifically, gates 15 and 16 are interposed between the sheet number counter 5' and the preset value register 6'. The comparator 41' is supplied with only the contents of the sheet number counter 5'. In addition, only the preset value display 8' is provided associated with the register 6'. The embodiment shown is adapted such that the sheet number counter 5' makes a down count for each sheet number pulse, whereas the embodiments discussed previously are adapted such that the sheet number counter 5 makes an up count for each sheet number pulse. Accordingly, the comparator 41' generates a photocopy uncompleted signal until the contents in the counter 5' turns to zero, and when the contents in the counter 5' become zero the comparator 41' generates a photocopy completed signal. In addition, the embodiment shown is adapted such that display of the number Y of the sheets so far photocopied and the preset value X is made by the preset value display 8' on a time sharing basis.

In operation, when an initial preset value X is key inputted by the ten key set 31, the preset value is stored in the preset value register 6' and is displayed by the preset value display 8'. Upon depression of the start key 1, the control 4 generates a gate signal for the gates 16. As a rsult the gate 16 is opened and accordingly the preset value X is transferred to the sheet number counter 5'. A down count or minus one (−1) signal is then generated by the control 4 and is applied to the counter 5' responsive to the sheet number pulse generated for each copying operation by the photocopying machine 200, whereby the sheet number counter 5' makes a down count operation for each photocopying operation. The control 4 alternately generates a gating signal for the gate 16 or 15 at a proper timing, whereby the gate 16 or 15 is opened and control is effected such that the preset value register 6' is stored with the preset value X and the photocopied sheet number Y (or the remaining sheet number "X - Y" to be photocopied) on a time sharing basis. Therefore, the set value display 8' makes display of the preset value and the photocopied sheet number on a time sharing basis. As far as the presetting change operation mode is concerned, the embodiments described in conjunction with FIGS. 1 through 4 are all applicable to the FIG. 5 embodiment.

Although in the foregoing the present invention was described as embodied in a photocopying machine control apparatus, it is to be understood by those skilled in the art that the present invention may be applied with simple modification to any other count control apparatus for controlling a processing unit based on a comparison between a desired preset number and a count number of the processing operations of the processing unit. For example, the inventive apparatus could be advantageously applied to a count control apparatus for controlling automatic vending machines for automatically vending tickets or the like, counting apparatuses for counting the number of post cards, game machines and the like. Thus, according to the present invention, a count control apparatus is provided wherein while a processing unit makes successive processing operations based on a preset value, a presetting change can be done with ease without stopping the processing operations.

Although this invention has been described and illustrated in detail, it is to be clearly understood that the same is by way of illustration and example only and is not to be taken by way of limitation, the spirit and scope of this invention being limited only by the terms of the appended claims.

What is claimed is:

1. A count control apparatus for controlling a processing unit, said processing unit being constructed to be enabled by an enabling signal to effect repetitive processing operations and to generate a count signal for each processing operation, said apparatus comprising counting means operatively coupled to said processing unit for counting the number of said count signals generated by said processing unit, means for presetting a desired number of processing operations to be carried out by said processing unit on a digit by digit basis, decision means operatively coupled to said counting means and said presetting means for judging whether the count value in said counting means is in a predetermined relationship with said preset numerical value, means responsive to said decision means for providing an enabling signal to said processing unit, said enabling signal being conditioned by the output of said decision means, manually operable means operatively coupled to said enabling signal providing means for making said enabling signal providing means non-responsive to said decision means, and means responsive to said manually operable means for causing said enabling signal providing means to generate a differently conditioned enabling signal, whereby said processing unit is normally enabled by said enabling signal generated by said enabling signal providing means as conditioned by the output of said decision means for performing the processing operations, but is differently enabled by said differently conditioned enabling signal generated by said enabling signal providing means, and whereby said preset number of processing operations may be changed without interrupting a current sequence of processing operations of the processing unit.

2. A count control apparatus in accordance with claim 1, which further comprises means operatively coupled to said enabling signal providing means for making said enabling signal providing means responsive to said decision means, thereby to terminate said enabling signal providing means being caused to generate an enabling signal as differently conditioned.

3. A count control apparatus in accordanc with claim 2, wherein said means for causing said enabling signal providing means to generate a differently conditioned enabling signal comprises state storing means responsive to said manually operable means for assuming one logic storing state and responsive to said means for making said enabling signal providing means responsive to said decision means for assuming the other logic storing state, and said enabling signal providing means is adapted to be responsive to said one logic storing state of said state storing means for generating said differently conditioned enabling signal.

4. A count control apparatus in accordance with claim 2, wherein said means for making said enabling signal providing means responsive to said decision means comprises further manually operable means coupled to said enabling signal providing means for making said enabling signal providing means responsive to said decision means.

5. A count control apparatus in accordance with claim 2, wherein said means for making said enabling signal providing means responsive to said decision means comprises means for measuring the amount of said processing operations effected by said processing unit after said enabling signal providing means is made non-responsive to said decision means and is caused to generate a differently conditioned enabling signal responsive to said first manually operable means, and means responsive to said measuring means for making said enabling signal providing means responsive to said decision means whenever a predetermined amout of processing operations is measured by said measuring means.

6. A count control apparatus in accordance with claim 5, wherein said means for measuring the amount of processing operations comprises means for counting the number of processing operations effected by said processing unit.

7. A count control apparatus in accordance with claim 5, wherein said means for measuring the amount of processing operations comprises means for measuring a time period of processing operations effected by said processing unit.

8. A count control apparatus in accordance with claim 1, wherein said means for causing said enabling signal providing means to generate a differently conditioned enabling signal comprises state storing means responsive to said manually operable means for assuming one logic storing state, and said enabling signal providing means is adapted to be responsive to said one logic storing state of said state storing means for generating said differently conditioned enabling signal.

9. A count control apparatus in accordance with claim 1, which further comprises means operatively coupled to said enabling signal providing means for disabling said enabling signal to disable said processing unit.

10. A count control apparatus in accordance with claim 9, wherein said means for disabling said enabling signal comprises further manually operable means for disabling said enabling signal.

11. A count control apparatus in accordance with claim 10, wherein said means for disabling said enabling signal comprises means for measuring the amount of said processing operations effected by said processing unit after said enabling signal is disabled, and means responsive to said measuring means for disabling said enabling signal whenever a predetermined amount of processing operations is measured by said measuring means.

12. A count control apparatus in accordance with claim 11, wherein said means for measuring the amount of processing operations comprises means for counting the number of processing operations effected by said processing unit.

13. A count control apparatus in accordance with claim 11, wherein said means for measuring the amount of processing operations comprises means for measuring a time period of processing operations effected by said processing unit.

14. A count control apparatus in accordance with claim 1, which further comprises means operatively coupled to said presetting means for registering a numerical value, and means responsive to said manually operable means for transferring said preset numerical value in said presetting means to said registering means, and wherein said decision means is adapted to be responsive to said manually operable means to judge the count value in said counting means being in a predetermined association with respect to said preset numerical value as transferred to said register means.

15. A count control apparatus in accordance with claim 1, wherein said decision means comprises comparator means for comparing the count value in said counting means with said preset numerical value in said presetting means.

16. A count control apparatus in accordance with claim 15, wherein said comparator means is structured to detect a coincidence between the count value in said counting means and said preset numerical value in said presetting means.

17. A count control apparatus in accordance with claim 15, wherein said counting means is structured to be initially loaded with said preset numerical value and to make a down count operation responsive to said count signal, and said comparator means is structured to detect when the contents in said counting means reaches zero.

18. A count control apparatus in accordance with claim 1, wherein said processing unit comprises a photocopying machine, and said processing operation comprises a photocopying operation effected by said photocopying machine.

19. A count control apparatus in accordance with claim 1, wherein said presetting means comprises keying input means for entering a numerical value, and registering means for storing said entered numerical value.

20. The apparatus of claim 19, wherein said keying input means comprise a ten key numerical value entry device.

21. A method for controlling a processing unit which is structured to be responsive to an enabling signal to perform repetitive processing operations and to provide a count signal for each processing operation, said method comprising the steps of presetting a desired number of processing operations to be carried out by said processing unit, providing an enabling signal to said processing unit, thereby to cause said processing unit to effect the repetitive processing operations, counting said count signal provided by said processing unit for each processing operation, comparing said preset number with said count number, causing said enabling signal to be conditioned by said comparison, releasing said conditioning of said enabling signal by said comparison, and causing said enabling signal to be differently conditioned, thereby to continue to provide said enabling signal, whereby said preset number of processing operations may be changed to another number without interrupting a current sequence of processing operations, changing said preset, desired number to a new desired preset number, and returning said conditioning of said enabling signal from said different condition to said comparison.

22. A method for controlling a processing unit in accordance with claim 22, which further comprises the steps of measuring the amount of processing operations after said conditioning of said enabling signal by said comparison is released.

23. A method of controlling a processing unit in accordance with claim 22, which further comprises the steps of detecting said amount of processing operations reaching a predetermined amount, and returning said conditioning of said enabling signal from said different condition to said comparison when said predetermined amount is detected.

24. A method for controlling a processing unit in accordance with claim 23, wherein said step of measuring the amount of processing operations comprises the step of counting the number of processing operations.

25. A method for controlling a processing unit in accordance with claim 23, wherein said step of measuring the amount of processing operations comprises the step of measuring a time period of the processing operations effected by said processing unit.

26. A method for controlling a processing unit in accordance with claim 22, which further comprises the steps of detecting said amount of processing operations reaching a predetermined amount, and disabling said enabling signal when said predetermined amount is detected.

27. A method for controlling a processing unit in accordance with claim 26, wherein said step of measuring the amount of processing operations comprises the step of counting the number of processing operations.

28. A method for controlling a processing unit in accordance with claim 26, wherein said step of measuring the amount of processing operations comprises the step of measuring a time period of the processing operations effected by said processing unit.

29. A count control apparatus for controlling a processing unit, said processing unit being constructed to be enabled by an enabling signal to effect repetitive processing operations and to generate a count signal for each processing operation, said apparatus comprising counting means operatively coupled to said processing unit for counting the number of said count signals generated by said processing unit, means for presetting a desired number of processing operations to be carried out by said processing unit on a digit by digit basis, decision means operatively coupled to said counting means and said presetting means for judging whether the count value in said counting means is in a predetermined relationship with said preset numerical value, means responsive to said decision means for providing an enabling signal to said processing unit, said enabling signal being conditioned by the output of said decision means, manually operable means operatively coupled to said enabling signal providing means for making said enabling signal providing means nonresponsive to said decision means, and gate means having inputs connected to said decision means and to said manually operable means, and outputs connected to said enabling signal generating means, whereby said processing unit is normally enabled by said enabling signal providing means unconditioned by the output of said decision means for operating the processing unit, said processing unit being differently enabled by said differently conditioned enabling signal received from said enabling signal providing means, whereby the preset number of processing operations may be changed without interrupting a current sequence of processing operations of the processing unit.

* * * * *

UNITED STATES PATENT OFFICE
CERTIFICATE OF CORRECTION

Patent No. 4,128,756 Dated December 5, 1978

Inventor(s) Akira Nagano et al

It is certified that error appears in the above-identified patent and that said Letters Patent are hereby corrected as shown below:

--[75] Akira Nagano, Nagaokakyo-shi, Kyoto-fu;
Kazuaki Urasaki, Muko-shi, Kyoto-fu;
Akira Osato, Mishima-shi, Shizuoka-ken;
Isao Sakurai, Nishitama-gun, Tokyo;
ALL OF JAPAN--.

Claim 22, line 2, replace "claim 22" by --claim 21--.

Signed and Sealed this
First Day of May 1979

[SEAL]

Attest:

RUTH C. MASON
Attesting Officer

DONALD W. BANNER
Commissioner of Patents and Trademarks